US007380655B1

(12) United States Patent
Thune et al.

(10) Patent No.: US 7,380,655 B1
(45) Date of Patent: Jun. 3, 2008

(54) HARD SIDED WALLET

(76) Inventors: Gregory S. Thune, 13336 Beach Ave., Marina del Ray, CA (US) 90292; Matthew H. Lazich, 13336 Beach Ave., Marina del Ray, CA (US) 90292

( * ) Notice: Subject to any disclaimer, the term of this patent is extended or adjusted under 35 U.S.C. 154(b) by 423 days.

(21) Appl. No.: 10/877,224

(22) Filed: Jun. 25, 2004

(51) Int. Cl.
*A45C 1/06* (2006.01)

(52) U.S. Cl. ..... 206/214; 206/37; 220/4.22; 220/844

(58) Field of Classification Search ..... 206/214, 206/37–39, 1.5; 220/843, 844, 830, 832, 220/4.22, 324; 150/132, 137, 143, 147, 149; 232/1 D; 16/255, 260–263, 277–279, 319, 16/321, 355, 356, 380, 381, 280, 285, 307, 16/298–301
See application file for complete search history.

(56) References Cited

U.S. PATENT DOCUMENTS

| | | | | |
|---|---|---|---|---|
| 1,407,239 A | | 2/1922 | Weiss | |
| 2,536,785 A | * | 1/1951 | Tamoschat | 220/4.22 |
| 2,575,030 A | * | 11/1951 | Smallman | 150/137 |
| 2,779,461 A | * | 1/1957 | Schweitzer | 206/37 |
| 3,092,244 A | | 6/1963 | McWhirter | |
| 3,648,832 A | * | 3/1972 | Kirshenbaum et al. | 206/37 |
| 4,075,702 A | | 2/1978 | Davies | |
| 4,236,560 A | * | 12/1980 | Reischauer | 150/119 |
| 4,419,788 A | * | 12/1983 | Prout | 16/300 |
| 5,036,973 A | | 8/1991 | Aida | |
| 5,121,834 A | | 6/1992 | Tissembaum | |
| 5,301,808 A | | 4/1994 | Pierson | |
| 5,394,913 A | * | 3/1995 | Zezza et al. | 150/146 |
| 5,644,516 A | * | 7/1997 | Podwalny et al. | 361/681 |
| 5,725,098 A | | 3/1998 | Seifert et al. | |
| 6,123,893 A | * | 9/2000 | Newby, Sr. | 264/516 |
| 6,239,968 B1 | | 5/2001 | Kim et al. | |
| 6,427,837 B1 | | 8/2002 | Shields | |
| 6,501,643 B1 | | 12/2002 | Sayers et al. | |
| 6,530,509 B1 | | 3/2003 | Davis | |
| 6,554,519 B1 | | 4/2003 | Kaplan | |

* cited by examiner

*Primary Examiner*—Mickey Yu
*Assistant Examiner*—Steven A. Reynolds
(74) *Attorney, Agent, or Firm*—Norton R. Townsley; Belasco Jacobs & Townsley, LLP

(57) ABSTRACT

A wallet comprising a concave top hingably attached to a concave bottom. The hinge pin has a central bore adapted to receive a cylindrical article. The top and bottom each include a half latch mechanism. There is also a spring attached to the hinge pin and bearing on either the top or the bottom and a pin, passing radially through the hinge pin and one of the hinge knuckles, for securing the hinge pin in place in the wallet assembly. The wallet remains closed when the top and bottom are latched to each other and will open by itself when the latch is unlatched. The wallet preferably includes a badge attached to the top and internal springs to retain items against the top and bottom.

37 Claims, 8 Drawing Sheets

HARD SIDED WALLET

BACKGROUND OF THE INVENTION

The present invention relates to the field of wallets and more particularly to wallets with a pivoted, latachable, hard, concave top and bottom and a protected space for containing an essentially cylindrical object.

Wallets are used to contain small items such as credit cards, coins, postage stamps, business cards, money or small pictures. They are generally sized and shaped to fit in a coat or pants pocket. However, most wallets provide little or no protection to the contents. They are useless for containing hard, shape or delicate items such as keys, screwdrivers, needles, pens, laser pointers, styli or pencils. Moreover, most wallets must be manually opened.

Development of a wallet which can protect and hold small objects and springs open at the release of a latch represents a great improvement in the field of wallets and satisfies a long felt need of the public.

SUMMARY OF THE INVENTION

The present invention is a wallet comprising a concave top hingably attached to a concave bottom. The hinge pin has a central bore adapted to receive a cylindrical article, which can be a pen, a pencil, a laser pointer, a cylindrical key or the like. The top and the bottom each include a latch mechanism. There is also a spring (or means for biasing) attached to the hinge pin and bearing on either the top or the bottom and a pin (or locking means) for securing the hinge pin in place in the wallet assembly. The pin goes radially through the hinge pin and one of the hinge knuckles. In this way the wallet will remain closed when the top and bottom are latched to each other and will open by itself (i.e. the top and bottom will spring away from each other under the action of the spring) when the latch is unlatched.

The wallet of this invention is fabricated by:

i) fabricating a concave top which includes at least one first hinge knuckle and half a latch mechanism;

ii) fabricating a concave bottom which includes at least one second hinge knuckle and the mating half latch mechanism;

iii) fabricating a hinge pin, with a central bore adapted to receive a cylindrical article, adapted to fit in the central opening of the hinge knuckles and including an adjustment mechanism;

iv) fabricating a biasing means (or spring) adapted to be attached to the hinge pin and to bear on either the or the bottom;

v) attaching the biasing means to the hinge pin;

vi) mating the hinge knuckles;

vii) inserting the hinge pin with attached biasing means into the central bore, thereby hingably attaching the top to the bottom and incorporating the biasing means so that the concave top and concave bottom are urged away from each other when the latch is unlatched;

viii) adjusting the bias in the biasing means with a screwdriver via the adjustment mechanism; and ix) securing the hinge pin within the central opening with a locking means or pin.

If the spring bears on the top the pin must go through one of the hinge knuckles integral with the bottom and vice versa. Preferably the top and bottom are made of cast metal, preferably aluminum. The adjustment mechanism may be adjusted via a screwdriver slot, radially in the wall of the hinge pin. Then a screwdriver may be used to wind up the spring before the pin is used to lock the hinge pin in place. The wallet may include a badge attached to the top. Preferably it also includes internal springs to retain items against the top and bottom and a concave area (or depression) in the bottom or enable the wallet to be comfortably carried in a hip pocket.

An appreciation of the other aims and objectives of the present invention and an understanding of it may be achieved by referring to the accompanying drawings and description of a preferred embodiment.

DETAILED DESCRIPTION OF THE PREFERRED EMBODIMENT

While the present invention is described herein with reference to illustrate embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 1:
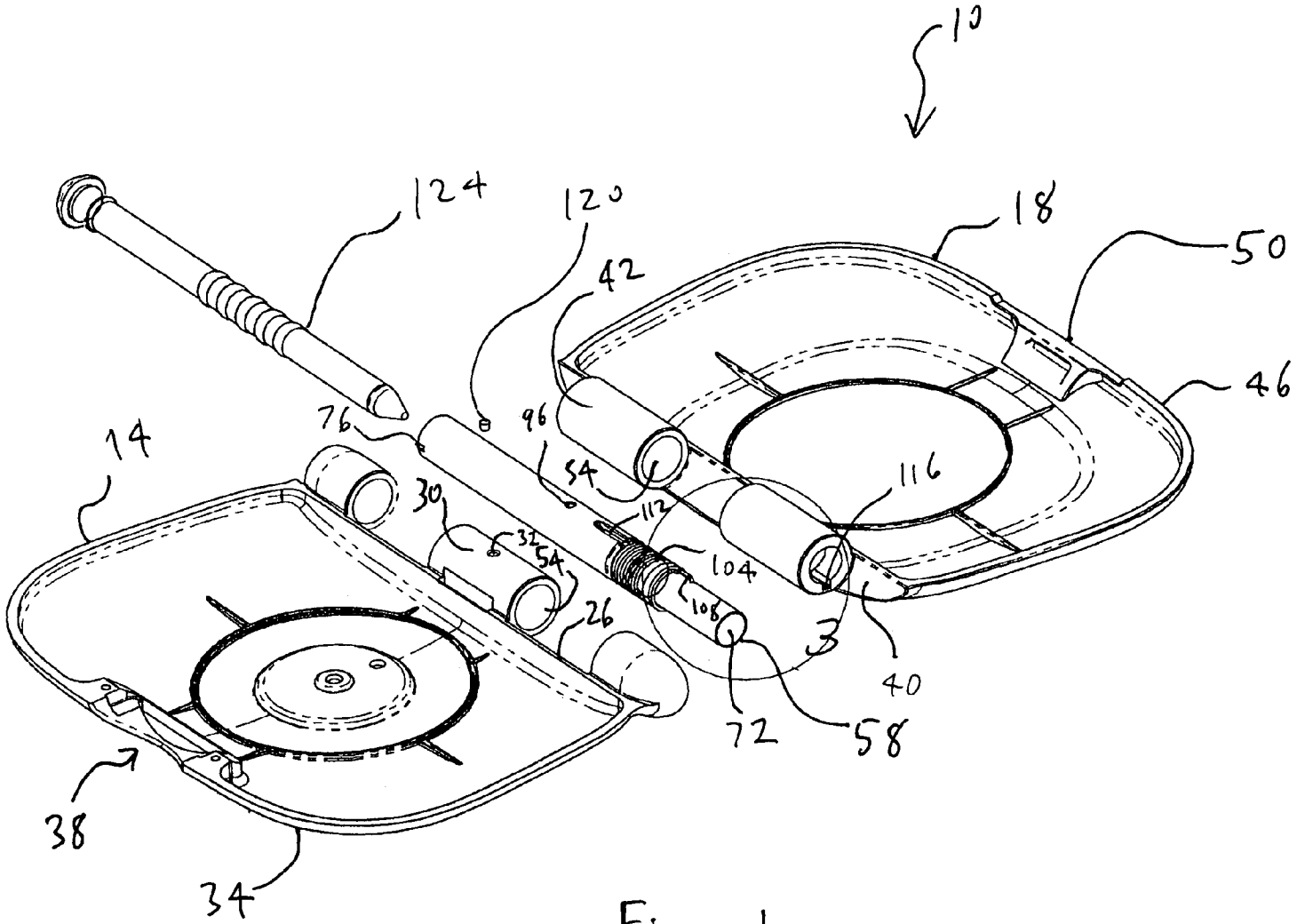
FIG. 1 is a partially exploded view of the wallet of this invention in the open configuration.
Figure 2:
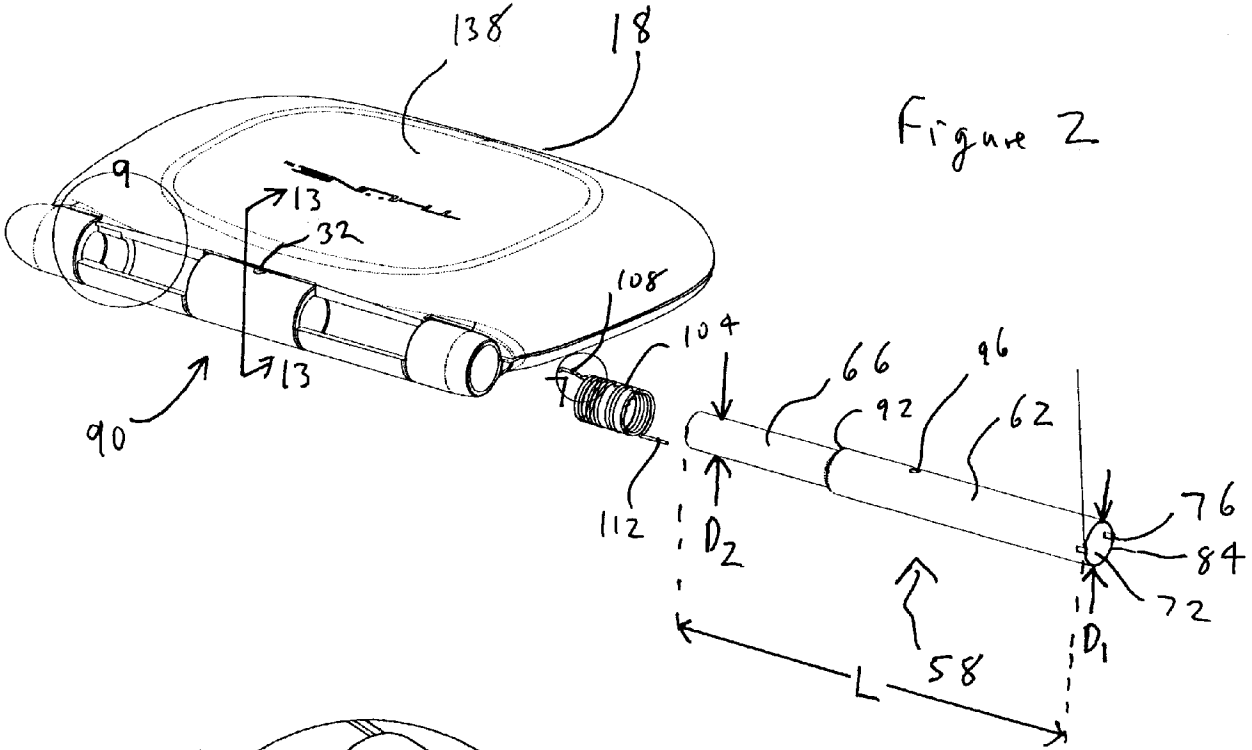
FIG. 2 is a partially exploded and partially cut-away view of the wallet of this invention in the closed configuration.
Figure 5:
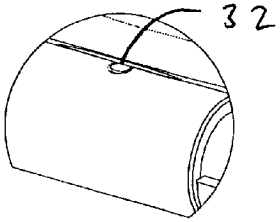
FIG. 5 is an enlargement of the detail included in circle 5 on FIG. 8.
Figure 13:
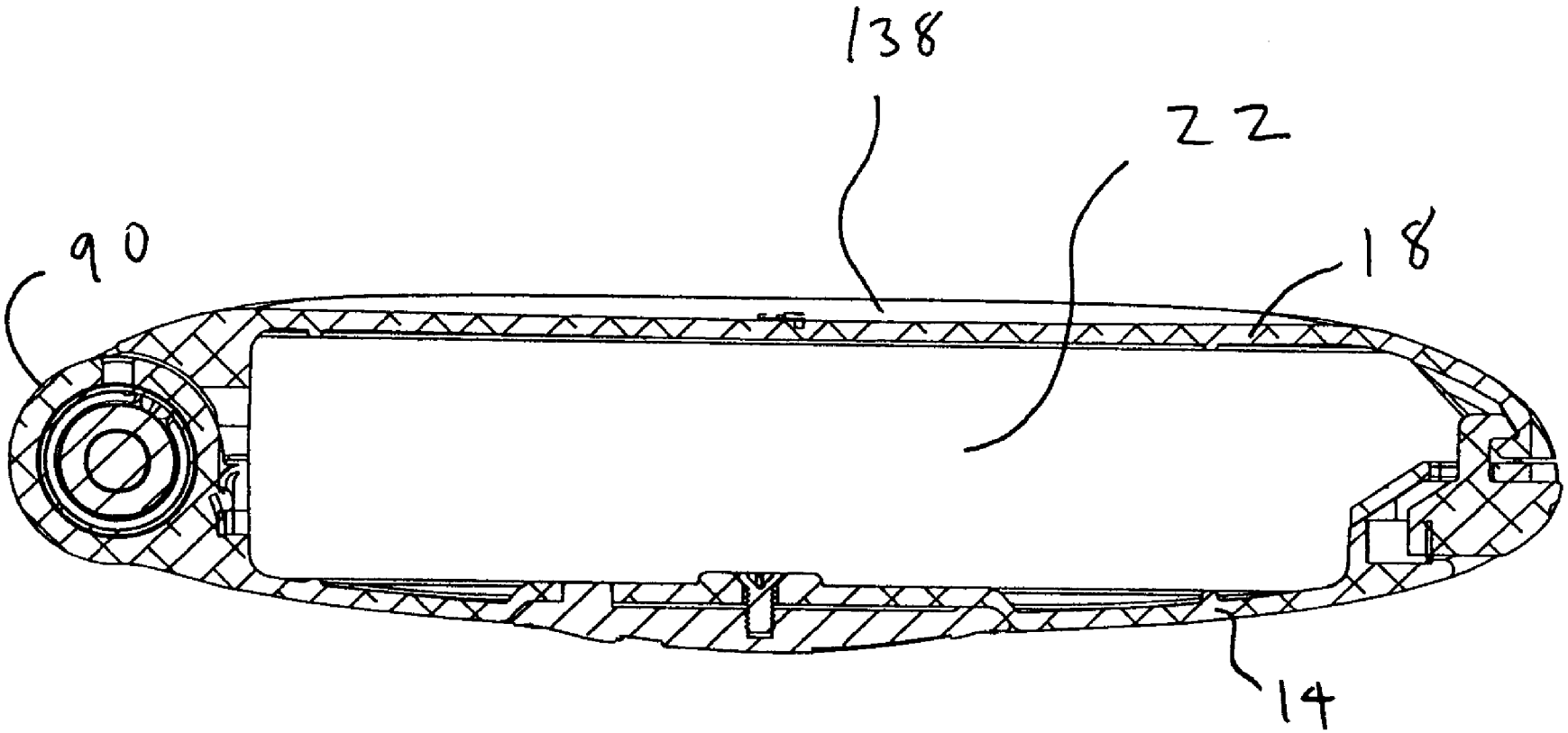
FIG. 13 is a cross section along the line 13-13 of FIG. 2.
Figure 14:
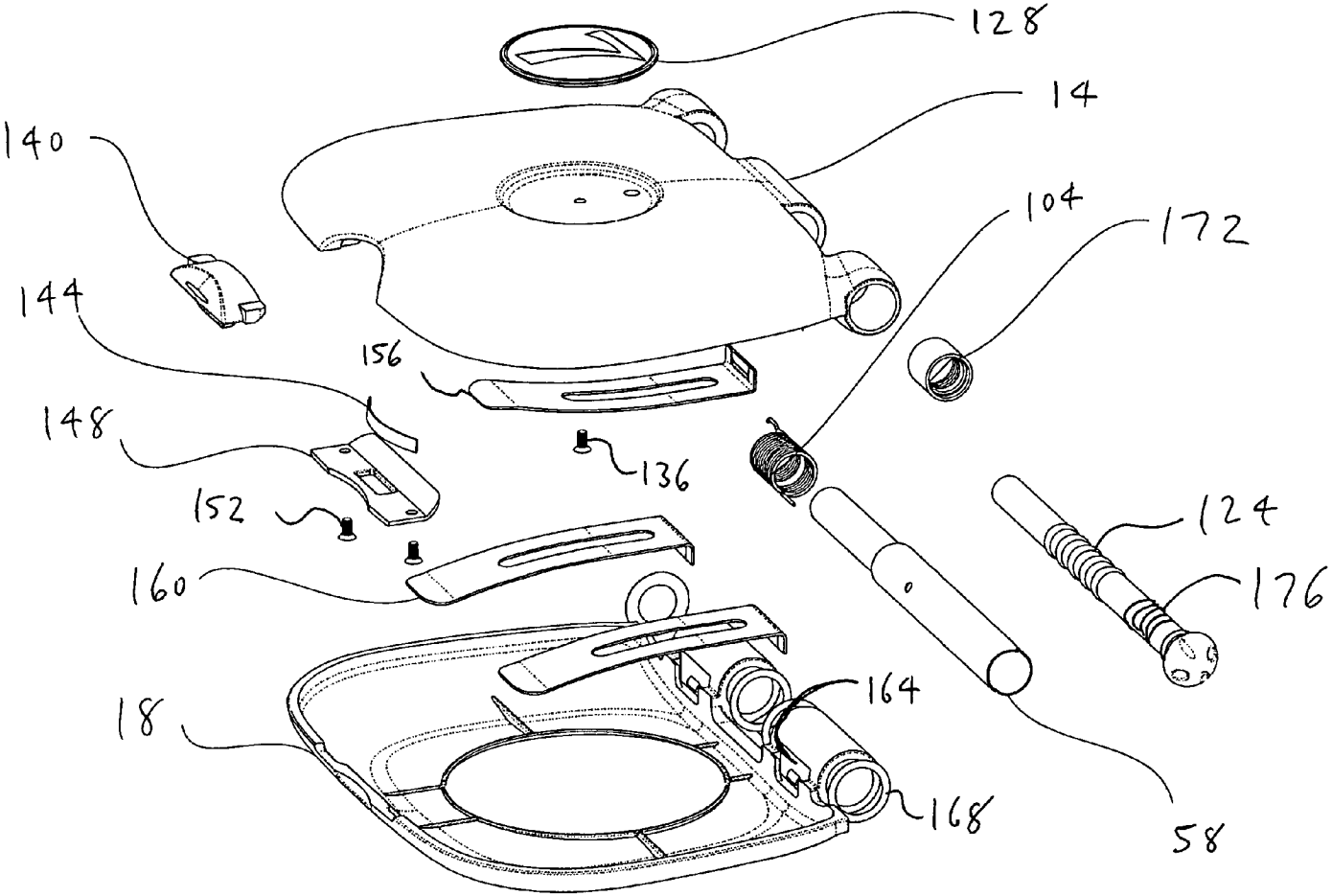
FIG. 14 is an exploded view of the preferred embodiment of this invention which includes internal retaining springs.

FIG. 1 is a partially exploded view of the wallet of this invention 10 in the open configuration. FIG. 2 is a partially exploded and partially cut-away view of the wallet of this invention 10 in the closed configuration. The invention 10 has a concave top 14 and a concave bottom 18. Preferably there is a concave area or depression 138 in the bottom 18. The top 14 and bottom 18 are designed to mate snugly with each other thereby defining an interior space 22. See FIG. 13. Exterior to one side 26 of the top 14 there is at least one hinge knuckle 30, constructed in accordance with the well known art of hinge construction. On another side 34 of the top 14 there is a first latch part 38. Although the sides 26, 34 are shown in the Figures as being opposite to each other, the sides 26, 34 could be adjacent. Exterior to one side 40 of the bottom 18 there is at least one hinge knuckle 42, constructed in accordance with the well known art of hinge construction. On another side 46 of the bottom 18 there is a second latch part 50. Again, sides 40, 46 could be opposite each other or adjacent. Each hinge knuckle 30, 42 has a central bore 54. The hinge knuckles 30, 42 are designed to mate with each other in accordance with the well known art of hinge assembly. There is a hole 32 through one of the hinge knuckle 30 approximately half way along the side 26. Also see FIG. 5. The latch parts 38, 50 are also designed to mate with each other and latch and unlatch the top 14 and bottom 18 to each other. The latch halves 38, 50 are designed in accordance with the well known art of latch construction. An exploded view of typical latch construction is shown in FIG. 14. This latch half 38 comprises a trigger 140, a spring 144, and a trigger holder 148 attached with a couple of screws 152.

Figure 3:
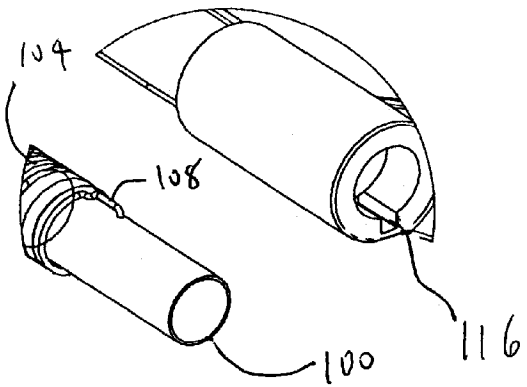
FIG. 3 is an enlargement of the detail included in circle 3 on FIG. 1.
Figure 4:
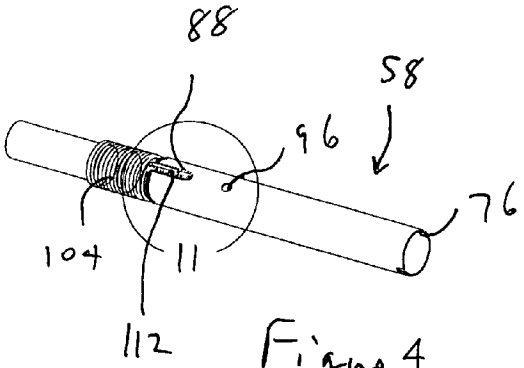
FIG. 4 is a perspective of the hinge pin/spring subassembly of this invention.

This invention has a hinge pin 58, which, while adapted to fit in the central openings 54 of the hinge knuckles 30, 42 in accordance with the well known art of hinge construction, has a special construction. As shown in FIGS. 2 and 4, the hinge pin 58 has a first section 62 with a first diameter $D_1$ and a section 66 with a second, smaller diameter $D_2$. The hinge pin 58 has a central bore 72 and a longitudinal groove 88 at the junction 92 between the two sections 62, 66. The groove 88 extends into the section 66 with the larger diameter $D_1$. The hinge pin 58 has a hole 96 through its wall 100 (see FIG. 3) approximately midway along its length L. When the invention 10 is assembled, holes 96 and 32 are aligned.

Figure 9:
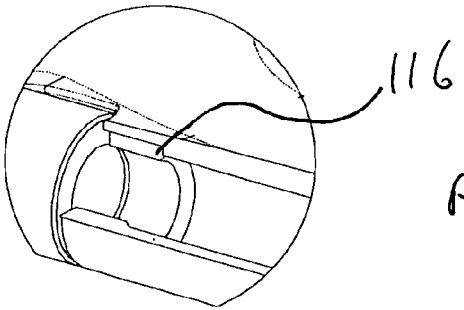
FIG. 9 is an enlargement of the detail included in circle 9 on FIG. 2.
Figure 7:
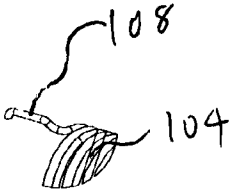
FIG. 7 is an enlargement of the detail included in circle 7 on FIG. 2.

A spring 104 is wound closely around and attached to the hinge pin 58. The spring 104 has a hook 108 at one end and a protrusion 112 at the other end. An enlarged view of the hook 108 is shown on FIG. 7. The protrusion is designed to fit into the groove 88. See FIG. 4. The bore 54 is adapted to accommodate the spring 104. Once the pin 58 and spring are within the bore 72 the protrusion 112 is trapped within groove 88. One of the hinge knuckles 42 of the bottom also includes an internal, longitudinal groove 116 (see also FIG. 3 and the enlarged view of FIG. 9). The pin 58 and spring 104 subassembly is assembled so that the hook 108 fits into this groove 116. Thus the hook 108 bears against the bottom 18. See FIGS. 8 and 10. When assembled, the spring biases the top 14 and bottom 18 away from each other.

Finally there is a means for locking the hinge pin 58 within the central bore 72. Preferably this means is a lock pin 120 which fits thorough holes 96 and 32. The diameters of the pins 120 and the holes 96 and 32 are preferably adjusted to provide a press fit. Alternatively, the exterior of the pin 120 and the interiors of the holes 96 and 32 could be threaded. Thus the pin becomes locked to the top 14 and the protrusion 112 becomes fixed in relation to the top 14. It will be clear to those most familiar with the art to which this invention pertains that the invention 10 could be designed so that the pin 58 is locked to the bottom 18 and the hook 108 bears against the top 14. Also, other means could be devised to provide bias urging the top 14 and bottom 18 to pivot away from each other along one side 26, 40.

Figure 8:
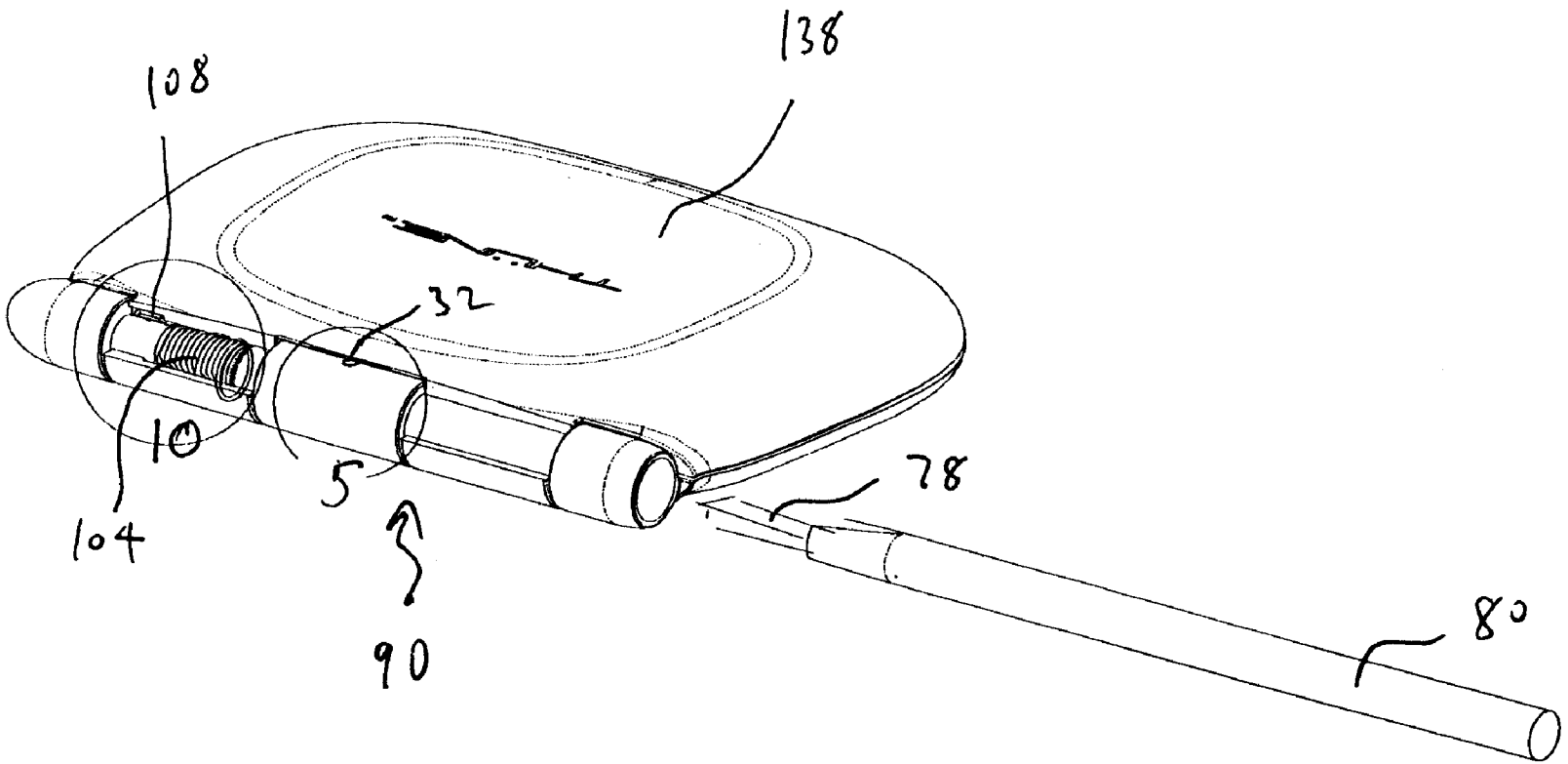
FIG. 8 is a partially cut away view of the wallet of this invention showing how a screwdriver may be used to adjust bias.

Means are provided for adjusting the bias in the spring 104. Preferably, the means is two, diametrically opposed, radial slots 76 for receiving the blade 78 of a screwdriver 80, at one end 84. See FIG. 8. The slots 76 could be in either end 84. As shown in FIG. 8, after the invention 10 is assembled but before the pin 120 is inserted into the holes 32, 96, the screwdriver 80 is inserted and turned so that a proper bias is provided. Then, before the screwdriver 80 is removed, the pin 120 is inserted into the holes 96 and 32. It will be clear to those most familiar with the art to which this invention 10 pertains that alternate means for adjusting bias in the spring 104 can be devised.

Figure 11:
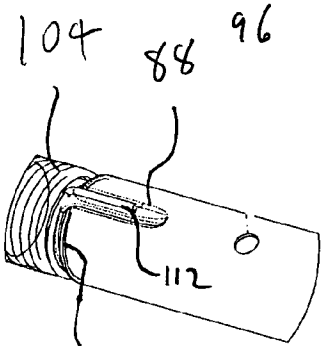
FIG. 11 is an enlargement of the detail included in circle 11 on FIG. 4.
Figure 10:
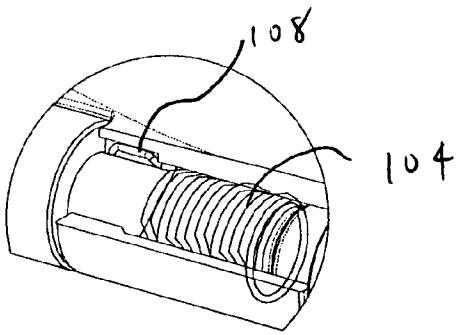
FIG. 10 is an enlargement of the detail included in circle 10 on FIG. 8.

To assemble the invention, the spring 104 is assembled to the hinge pin 58 with the protrusion 112 fitting in the groove 88. See FIGS. 4 and 11. The hinge knuckles 30, 42 are mated so that the bores 54 align. Shims or washers 168 may be inserted between the hinge knuckles 30, 42 to reduce wear. See FIG. 14. The hinge pin 58/spring 104 subassembly is inserted into the bore 54 until it is flush and so that the hook 108 fits into the groove 116 and the holes 32, 96 align. This forms a hinge 90. FIG. 10 better illustrates how the hook fits in the groove 116. A screwdriver 80 is inserted into the slots 76 and turned to adjust the bias in the spring 104. See FIG. 8. Then the locking pin 120 is inserted into the holes 32, 96.

The wallet of this invention 10 could be made of any suitable material such as metal or plastic. Preferably, however, the top 14 and bottom 18 are made of aluminum, preferably cast aluminum.

Figure 6:
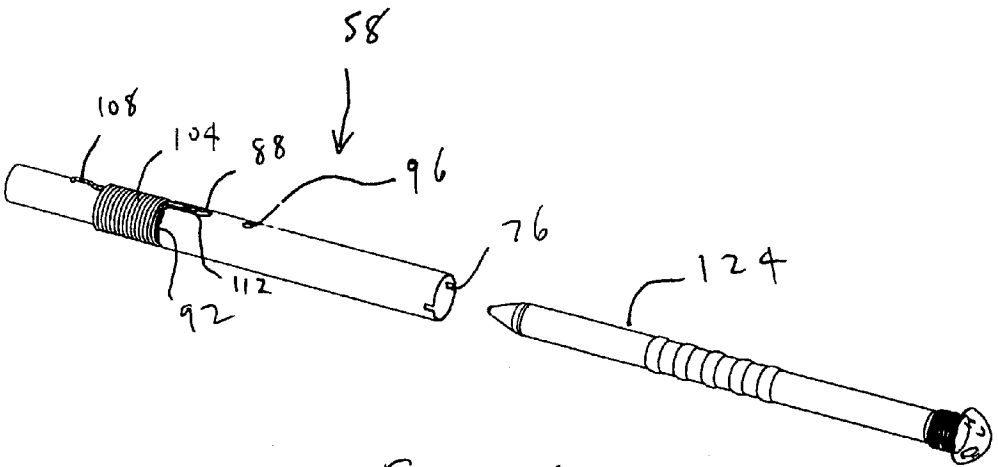
FIG. 6 is a perspective, partially exploded view of the hinge pin/spring subassembly of this invention and a typical cylindrical object.

The bore 72 in the pin 58 is preferably designed to accommodate a pen 124. The respective diameters of the bore 72 and pen 124 are adjusted so that the pen 124 will not fall out of the bore 72 but that inordinate manual force is not required to remove the pen 124 from the bore. Alternatively an internally threaded insert 172 may be affixed in the bore 72 and the barrel of the pen 124 provided with mating threads 176. In this way the pen 124 can be screwed into and out of the bore 78. It will be obvious to those familiar with the art to which this invention 10 pertains that other means can be devised for temporarily affixing the pen within the bore and that any other cylindrical or near cylindrical object can be inserted into the bore 72. Suitable cylindrical objects include laser pointers, styli, cylindrical keys and pencils. See FIG. 6.

Figure 12:
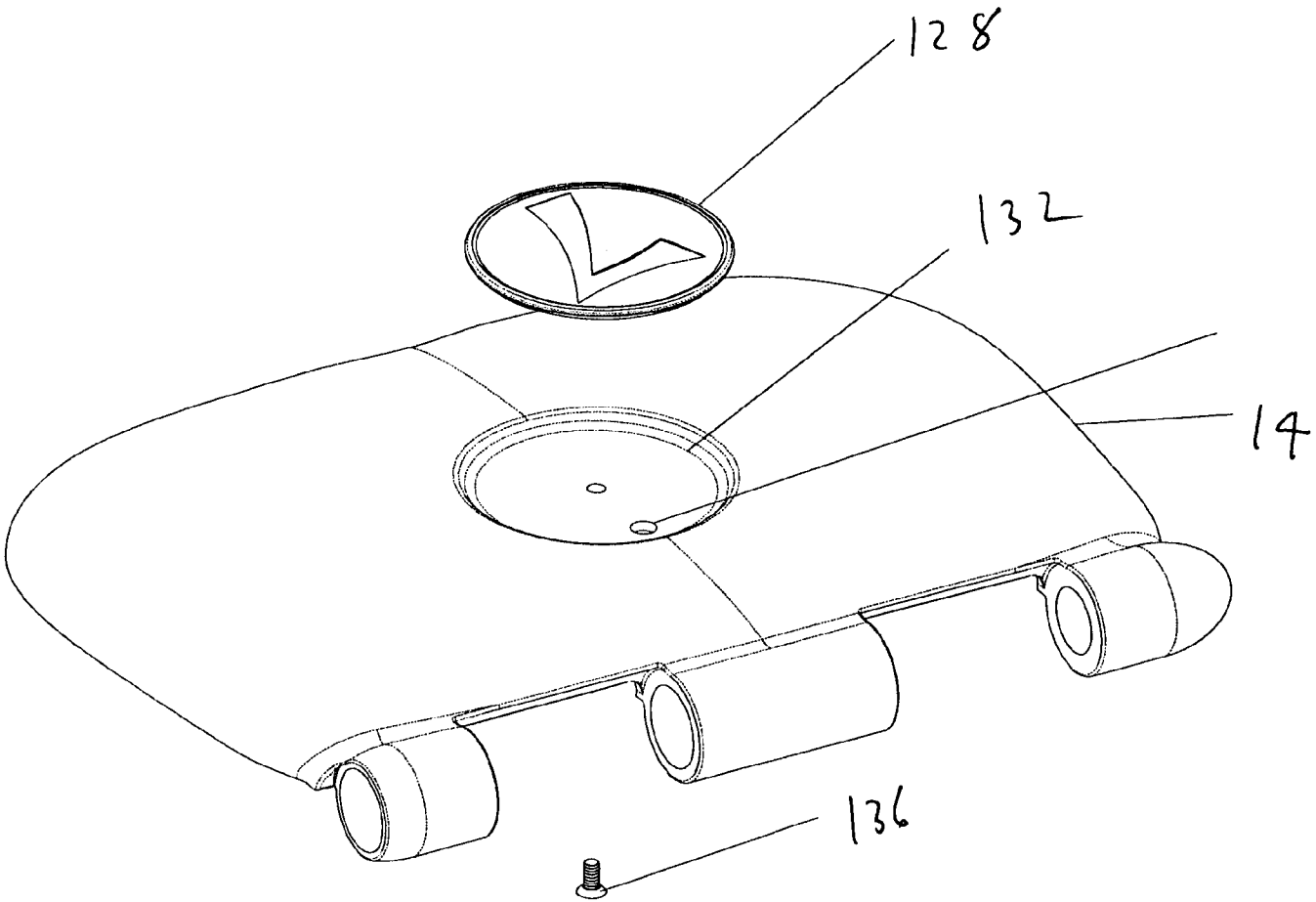
FIG. 12 is a illustration showing attachment of a badge.

In an alternate embodiment, this invention further comprising a badge or medallion 128 attached to the top 14. Preferably, a depression 132 is provided in the top 14 and the medallion 128 attached with a screw 136. See FIG. 12. In this way customized badges 128 can be provided. It will be clear to those most familiar with the art to which this invention 10 pertains that alternate means for attaching a badge 128 to the top 14 can be devised.

The preferred embodiment of this invention further comprises at least one internal spring 156 attached to the top 14 and at least one internal spring 160 attached to the bottom 18. These springs 156, 160 have an elongated shape and are preferably attached to the interior of the hinge knuckle 164. In this way the springs 156, 160 retain items snugly against the top 14 and bottom 18 to prevent rattling.

The following reference numerals are used on FIGS. 1 through 14:

10 Wallet of this invention
14 Concave top
18 Concave bottom
22 Interior space
26 One side of top
30 Hinge knuckle of top
32 Hole through hinge knuckle
34 Another side of top
38 First latch part
40 One side of bottom
42 Hinge knuckle of bottom
46 Another side of bottom

50 Second latch part
54 Central bore of hinge knuckles
58 Hinge pin
62 First section of hinge pin with diameter $D_1$
66 Second section of hinge pin with diameter $D_2$
72 Central bore of hinge pin
76 Slot
78 Blade of screwdriver
80 Screwdriver
84 End of hinge pin
88 Longitudinal groove in section of hinge pin with larger diameter $D_1$
90 Hinge
96 Hole through wall of hinge pin
100 Wall of hinge pin
104 Spring
108 Hook
112 Protrusion
116 Internal longitudinal groove in bottom hinge knuckle
120 Locking pin
124 Pen or other cylindrical article
128 Badge or medallion
132 Depression in top
136 Attaching screw
138 Concave area in bottom
140 Trigger
144 Latch spring
148 Trigger holder
152 Screw
156 Spring attached to top
160 Spring attached to bottom
164 Spring attachment point
168 Shim or washer
172 Internally threaded insert
176 Threads on barrel of pen or other cylindrical article—mating with threads on insert Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

What is claimed is:

1. A wallet comprising:

i) a concave top; said concave top including a first hinge knuckle at one side and a first latch part at another side;

ii) a concave bottom; said concave bottom including a second hinge knuckle at one side and a second latch part at another side; said top and bottom designed to mate with each other thereby defining an interior space; said first and second hinge knuckles designed to mate with each other; said first and second hinge knuckles having a first central bore; said first and second latch parts designed to mate thereby to latch and unlatch said top and bottom to each other;

iii) a hinge pin adapted to fit in the central openings of said hinge knuckles thereby forming a hinge whereby said concave top and concave bottom may rotate with respect to each other; said hinge pin having a second central bore; said second central bore adapted to receive a cylindrical article;

iv) a biasing means attached to said hinge pin for urging said top and bottom to pivot away from each other when said latch is unlatched; said biasing means being locked to one of said top and said bottom and bearing against one of said bottom and said top respectively; said biasing means being locked via said first hinge knuckle to said top; said biasing means being locked via said second hinge knuckle to said bottom; said biasing means bearing against said bottom via said second hinge knuckle; said biasing means bearing against and said top via said first hinge knuckle; and v) a locking means for locking said hinge pin within said central opening.

2. A wallet as claimed in claim 1 in which said biasing means comprises a spring.

3. A wallet as claimed in claim 1 in which said locking means comprises a pin through said hinge pin and said first hinge knuckle.

4. A wallet as claimed in claim 1 in which said locking means comprises a pin through said hinge pin and said second hinge knuckle.

5. A wallet as claimed in claim 1 in which said concave top comprises cast aluminum.

6. A wallet as claimed in claim 1 in which said concave bottom comprises cast aluminum.

7. A wallet as claimed in claim 1 in which said cylindrical article is selected from the group consisting of a pen, a laser pointer, a stylus, a cylindrical key and a pencil.

8. A wallet as claimed in claim 1 further comprising a means for adjusting the bias of said biasing means.

9. A wallet as claimed in claim 8 in which said means for adjusting the bias is a radial slot in an end of said hinge pin; said radial slot adapted to receive the blade of a screwdriver.

10. A wallet as claimed in claim 1 further comprising a badge attached to said concave top.

11. A wallet as claimed in claim 1 further comprising a second biasing means for retaining a first item against said concave top and a third biasing means for retaining a second item against said concave bottom.

12. A wallet as claimed in claim 11 in which said second and third biasing means are elongated springs.

13. A wallet as claimed in claim 1 in which said concave bottom further includes a concave area.

14. A method of manufacturing a wallet comprising the steps of:

i) fabricating a concave top; said concave top including a first hinge knuckle at one side and a first latch part at another side;

ii) fabricating a concave bottom; said concave bottom including a second hinge knuckle at one side and a second latch part at another side; said top and bottom designed to mate with each other thereby defining an interior space; said first and second hinge knuckles designed to mate with each other; said first and second hinge knuckles having a first central bore; said first and second latch parts designed to mate and thereby to latch and unlatch said top and bottom to each other;

iii) fabricating a hinge pin adapted to fit in the central opening of said hinge knuckles; said hinge pin having a second central bore and means for adjustment; said second central bore adapted to receive a cylindrical article;

iv) fabricating a biasing means for urging said top and bottom to pivot away from each other when said latch is unlatched;

v) attaching said biasing means to said hinge pin;

vi) mating said hinge knuckles;

vii) inserting said hinge pin with attached biasing means into said central bore thereby forming a hinge whereby said top and bottom may rotate with respect to each other and incorporating said biasing means so that said concave top and concave bottom are urged away from each other when said latch is unlatched;

viii) locking said biasing means to one of said and said bottom so that said biasing means bears against one of said bottom and said top, respectively; said biasing means being locked via said first hinge knuckles to said top; said biasing means being locked via said second hinge knuckle to said bottom; said biasing means bearing against said bottom via said second hinge knuckle; said biasing means bearing against and said top via said first hinge knuckle;

ix) adjusting the bias in said biasing means via said means for adjustment;

x) providing a locking means for locking said hinge pin within said central opening; and xi) locking said hinge pin within said central opening with said locking means.

15. A method of fabricating a wallet as claimed in claim 14 in which the method of fabricating said concave top is casting.

16. A method of fabricating a wallet as claimed in claim 15 in which the method of fabricating said concave top is casting from aluminum alloy.

17. A method of fabricating a wallet as claimed in claim 14 in which the method of fabricating said concave bottom is casting.

18. A method of fabricating a wallet as claimed in claim 17 in which the method of fabricating said concave bottom is casting from aluminum alloy.

19. A method of fabricating a wallet as claimed in claim 14 in which the method of fabricating said biasing means comprises the step of fabricating a spring designed to:

i) fit around said hinge pin;

ii) attach to said hinge pin; and iii) bear against one of said concave top and said concave bottom.

20. A method of fabricating a wallet as claimed in claim 14 in which said cylindrical article is selected from the group consisting of a pen, a laser pointer, a stylus, a cylindrical key and a pencil.

21. A method of fabricating a wallet as claimed in claim 14 in which the method of fabricating said means for adjustment comprises the step of machining a radial slot in said hinge pin; said radial slot adapted to receive the blade of a screwdriver.

22. A method of fabricating a wallet as claimed in claim 14 in which said locking means comprises a pin and further comprising the step of inserting said pin through said hinge pin and said first hinge knuckle.

23. A method of fabricating a wallet as claimed in claim 14 in which said locking means comprises a pin and further comprising the step of inserting said pin through said hinge pin and said second hinge knuckle.

24. A method of fabricating a wallet as claimed in claim 14 further comprising the steps of i) providing a badge;

ii) attaching said badge to said top.

25. A method of fabricating a wallet as claimed in claim 14 further comprising the steps of:

i) providing a second biasing means for retaining a first item against said concave top ii) providing a third biasing means for retaining a second item against said concave bottom;

ii) attaching said second biasing means to said concave top; and iii) attaching said third biasing means to said concave bottom.

26. A wallet as claimed in claim 14 in which said concave bottom further includes a concave area.

27. A container comprising:

a) a concave top; said concave top including a first hinge knuckle at one side and a first latch part at another side;

b) a concave bottom; said concave bottom including a second hinge knuckle at one side and a second latch part at another side; said top and bottom designed to mate with each other thereby defining an interior space; said first and second hinge knuckles designed to mate with each other; said first and second hinge knuckles having a first central bore; said first and second latch-parts designed to mate thereby to latch and unlatch said top and bottom to each other;

c) a hinge pin adapted to fit in the central openings of said hinge knuckles thereby forming a hinge whereby said concave top and concave bottom may rotate with respect to each other; said hinge pin having a second central bore; said second central bore adapted to receive a cylindrical article;

d) a biasing means attached to said hinge pin for urging said top and bottom to pivot away from each other when said latch is unlatched; and e) a locking means for locking said hinge pin within said central opening;

f) said container further comprising a condition selected from one of:

i) said biasing means is locked to said top via said first hinge knuckle and bears against said bottom via said second hinge knuckle;

ii) said locking means comprises a pin through said hinge pin and said first hinge knuckle;

iii) said biasing means is locked to said bottom via said second hinge knuckle and bears against said top via said first hinge knuckle;

iv) said locking means comprises a pin through said hinge pin and said second hinge knuckle;

v) said container further comprises a means for adjusting the bias of said biasing means.

28. A container as claimed in claim 27 in which said concave top comprises cast aluminum.

29. A container as claimed in claim 27 in which said concave bottom comprises cast aluminum.

30. A container as claimed in claim 27 in which said means for adjusting the bias is a radial slot in an end of said hinge pin; said radial slot adapted to receive the blade of a screwdriver.

31. A container as claimed in claim 27 further comprising a badge attached to said concave top.

32. A container as claimed in claim 27 in which said cylindrical article is selected from the group consisting of a pen, a laser pointer, a stylus, a cylindrical key and a pencil.

33. A method of manufacturing a container comprising the steps of:

a) fabricating a concave top; said concave top including a first hinge knuckle at one side and a first latch part at another side;

b) fabricating a concave bottom; said concave bottom including a second hinge knuckle at one side and a second latch part at another side; said top and bottom designed to mate with each other thereby defining an interior space; said first and second hinge knuckles designed to mate with each other; said first and second hinge knuckles having a first central bore; said first and second latch parts designed to mate and thereby to latch and unlatch said top and bottom to each other;

c) fabricating a hinge pin adapted to fit in the central opening of said hinge knuckles; said hinge pin having a second central bore and means for adjustment; said second central bore adapted to receive a cylindrical article;

d) fabricating a biasing means for urging said top and bottom to pivot away from each other when said latch is unlatched;

e) attaching said biasing means to said hinge pin;

f) mating said hinge knuckles;

g) inserting said hinge pin with attached biasing means into said central bore thereby forming a hinge whereby said top and bottom may rotate with respect to each other and incorporating said biasing means so that said concave top and concave bottom to are urged away from each other when said latch is unlatched;

h) adjusting the bias in said biasing means via said means for adjustment;

i) providing a locking means for locking said hinge pin within said central opening; and j) locking said hinge pin within said central opening with said locking means;

k) further comprising a step selected from one of:

i) the method of fabricating said concave top is casting;

ii) the method of fabricating said concave bottom is casting;

iii) the method of fabricating said concave top is casting from aluminum alloy;

iv) the method of fabricating said concave bottom is casting from aluminum alloy;

v) the method of fabricating said means for adjustment comprises the step of machining a radial slot in said hinge pin; said radial slot adapted to receive the blade of a screwdriver;

vi) said locking means comprises a pin and inserting said pin through said hinge pin and said first hinge knuckle.

34. A method of fabricating a container as claimed in claim 33 further comprising the step of locking said spring to said top via said first hinge knuckle, whereby said spring bears against said bottom via said second hinge knuckle.

35. A method of fabricating a container as claimed in claim 33 further comprising the step of locking said spring to said bottom via said second hinge knuckle, whereby said spring bears against said top via said first hinge knuckle.

36. A method of fabricating a container as claimed in claim 33 further comprising the step of providing a badge and attaching said badge to said top.

37. A method of fabricating a container as claimed in claim 33 in which said cylindrical article is selected from the group consisting of a pen, a laser pointer, a stylus, a cylindrical key and a pencil.

* * * * *